US007216466B2

(12) United States Patent
Nystrom

(10) Patent No.: US 7,216,466 B2
(45) Date of Patent: May 15, 2007

(54) UNIVERSAL RIDGE CLIP

(75) Inventor: Bruce C. Nystrom, Milford, IA (US)

(73) Assignee: Metal Works, Inc., Spencer, IA (US)

( * ) Notice: Subject to any disclaimer, the term of this patent is extended or adjusted under 35 U.S.C. 154(b) by 186 days.

(21) Appl. No.: 10/967,455

(22) Filed: Oct. 18, 2004

(65) Prior Publication Data

US 2006/0096233 A1 May 11, 2006

(51) Int. Cl.
*E04D 13/12* (2006.01)

(52) U.S. Cl. ..... 52/712; 52/42; 52/43; 52/44

(58) Field of Classification Search ..... 52/698, 52/712, 715, 198, 41–44, 730.6, 731.7; 403/232.1, 403/389, 233
See application file for complete search history.

(56) References Cited

U.S. PATENT DOCUMENTS 1,075,123 A * 10/1913 Scheas ..... 52/240
1,547,184 A * 7/1925 Venzie ..... 52/355
1,626,589 A * 5/1927 Alber ..... 52/367
2,433,527 A * 12/1947 Mohr et al. ..... 160/19
3,395,378 A * 7/1968 Ericson ..... 439/131
3,977,640 A * 8/1976 Arnold et al. ..... 248/542
4,480,941 A * 11/1984 Gilb et al. ..... 403/232.1
4,517,776 A * 5/1985 Barker ..... 52/90.1
4,562,921 A * 1/1986 Leemkuil et al. ..... 198/841
4,592,536 A * 6/1986 Jasinski ..... 254/8 R
5,564,248 A * 10/1996 Callies ..... 52/702
6,330,853 B1 * 12/2001 Yu ..... 99/421 H
6,367,617 B1 * 4/2002 Schiesser et al. ..... 198/782
6,560,943 B1 * 5/2003 Leek et al. ..... 52/715
6,640,516 B1 * 11/2003 Thompson ..... 52/712
6,662,510 B2 * 12/2003 Rotter ..... 52/199

* cited by examiner

*Primary Examiner*—Jeanette Chapman
(74) *Attorney, Agent, or Firm*—McKee, Voorhees & Sease, P.L.C.

(57) ABSTRACT

The present invention is a universal ridge clip for attachment of a ridge cap along the peak of a centrally located roof ridge, usually on metal buildings. The clip may also be used on a "hip" roof application. The ridge clip is of a construction such that it provides a strong support area for the ridge cap without the need for fasteners that would penetrate the roof panel at exposed areas to the weather. It generally is a Z-shaped clip having a top fastening area, and a bottom anchoring area with these joined by a generally upright panel having a notch therein to allow roof ribs to pass through the notch.

2 Claims, 5 Drawing Sheets

UNIVERSAL RIDGE CLIP

BACKGROUND OF THE INVENTION

The present invention relates to the field of ridge caps for metal buildings. More particularly, this invention relates to a roof ridge clip for a frame style building having a peaked roof. The invention is generally well adapted to metal buildings which are often used for storage on farms and the like. The invention provides a ridge clip to which a ridge cap can attach with a minimum of penetration of the exposed area of the roof panel (either penetrating the flat area of the roof panel or the major rib of the corrugation).

Roof ridge caps are attached to the roof in such a manner that fasteners, usually screws or pop rivets penetrate the roof panel or the major rib corrugation. There is a risk of rust, leakage, etc. This can be alleviated by use of weather proofing materials at additional cost and the requirement for substantial additional field time and labor.

Accordingly a primary objective of the present invention is to provide a roof ridge clip, useable to attach ridge caps along the peak of the roof, in a manner that avoids any fasteners penetrating the roof panel in an area that is exposed to weather.

Yet another objective is to provide a roof ridge clip that is easy to install, easy to manufacturer and which can be used with a variety of dimensioned ribs of corrugated roof panels while at the same time being installed with substantially minimal field time and cost.

The manner of achieving and accomplishing these objectives as well as others will become apparent from the drawings, the detailed description and the claims which follow.

SUMMARY OF THE INVENTION

The present invention is a universal ridge clip for attachment of a ridge cap along the peak of a centrally located roof ridge, usually on metal buildings. The ridge clip is of a construction such that it provides a strong support area for the ridge cap without the need for fasteners that would penetrate the roof panel at exposed areas to the weather. It generally is a Z-shaped clip having a top fastening area, and a bottom anchoring area with these joined by a generally upright panel having a notch therein to allow roof ribs to pass through the notch.

DETAILED DESCRIPTION OF THE PREFERRED EMBODIMENT

Figure 1:
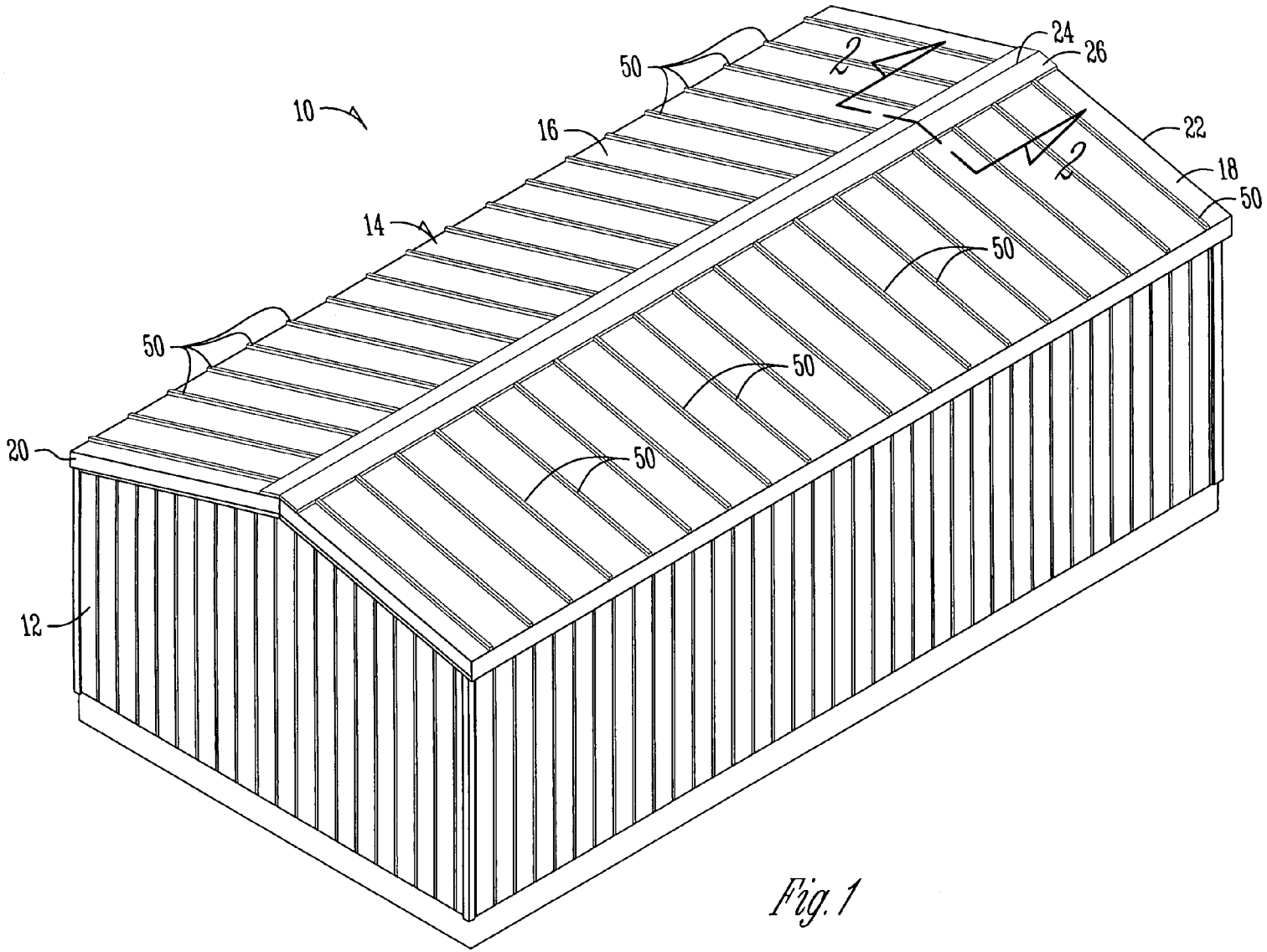
FIG. 1 is a perspective view of a typical metal building with a peaked roof and having a ridge cap.

In FIG. 1 a conventional building 10 has a plurality of building sides 12 covered by a roof 14. The roof 14 has roof sides 16 and 18 with the opposing ends 20 and 22 of sides 16 and 18 angling up to a roof peak 24. Peak 24 is underneath the centrally located ridge cap 26.

Figure 2:
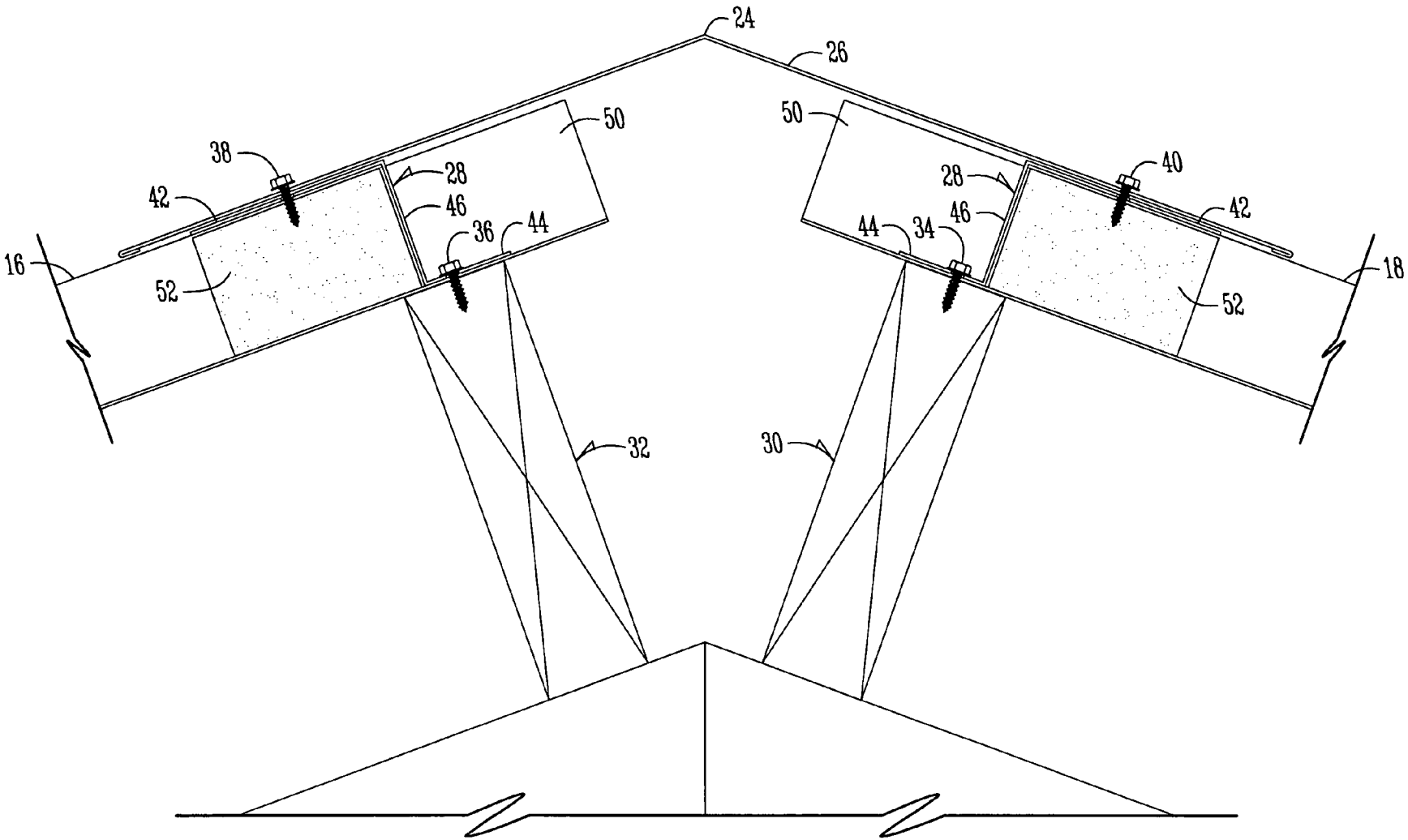
FIG. 2 is a view along line 2—2 of FIG. 1 showing how the ridge clips work to attach the ridge cap.

FIG. 2 shows the major components of the ridge clip 28 generally in place to fasten a ridge cap 26 to the fastening are of the ridge clip 28. The ridge clip is fastened through the roof panel and into trusses 30 and 32 via screws 34 and 36. The ridge cap 26 is then attached into the fastening area of the ridge clip 28 via screws 38 and 40.

Figure 3:
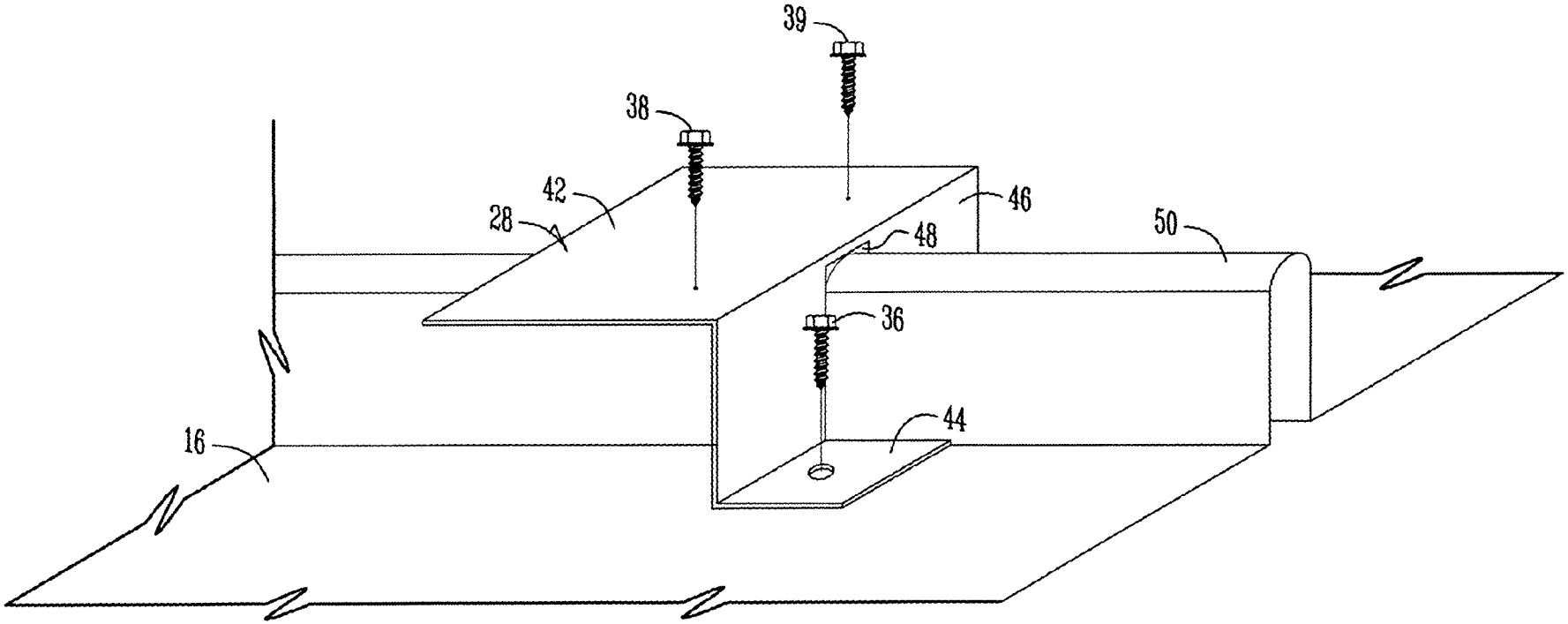
FIG. 3 is a perspective view of the roof panel showing a roof rib passing through the notch therein and showing how the ridge clip can be attached.
Figure 6:
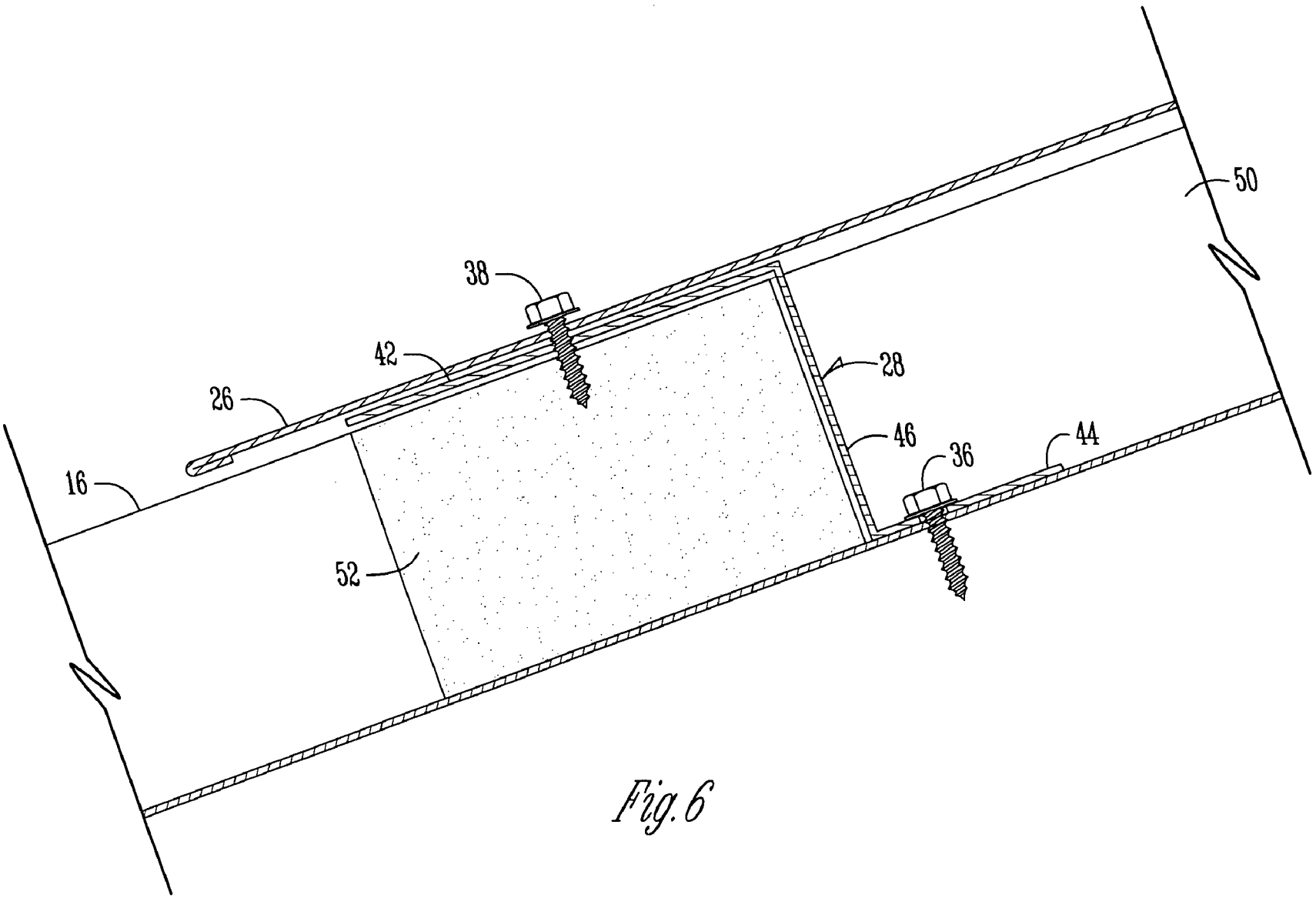
FIG. 6 shows a sectional view using the Z clip and showing it with an attached ridge cap.

The precise construction of the ridge clip 28 is perhaps best illustrated in FIGS. 3 and 6. There ridge clip 28 can be seen to be comprised of a Z-shaped ridge clip 28 having a top fastening area 42 and a bottom anchoring area 44 joined together by a generally upright panel 46 having a notch 48 therein to allow a roof rib 50 to pass therethrough. The bottom anchoring area 44 may be attached to the roof panel 16 and 18 via screw 36. Correspondingly ridge cap 26 may be attached via screws 38 and 39 through top fastening area 42 without penetrating the rib 50. The area between the ribs is filled with a venting material 52 or flexible closure material to prevent infiltration. As can be seen, the bottom anchoring area 44 is attached to the roof panel underneath ridge cap 26 so that the point of fastening 36 is not exposed to the weather.

Figure 4:
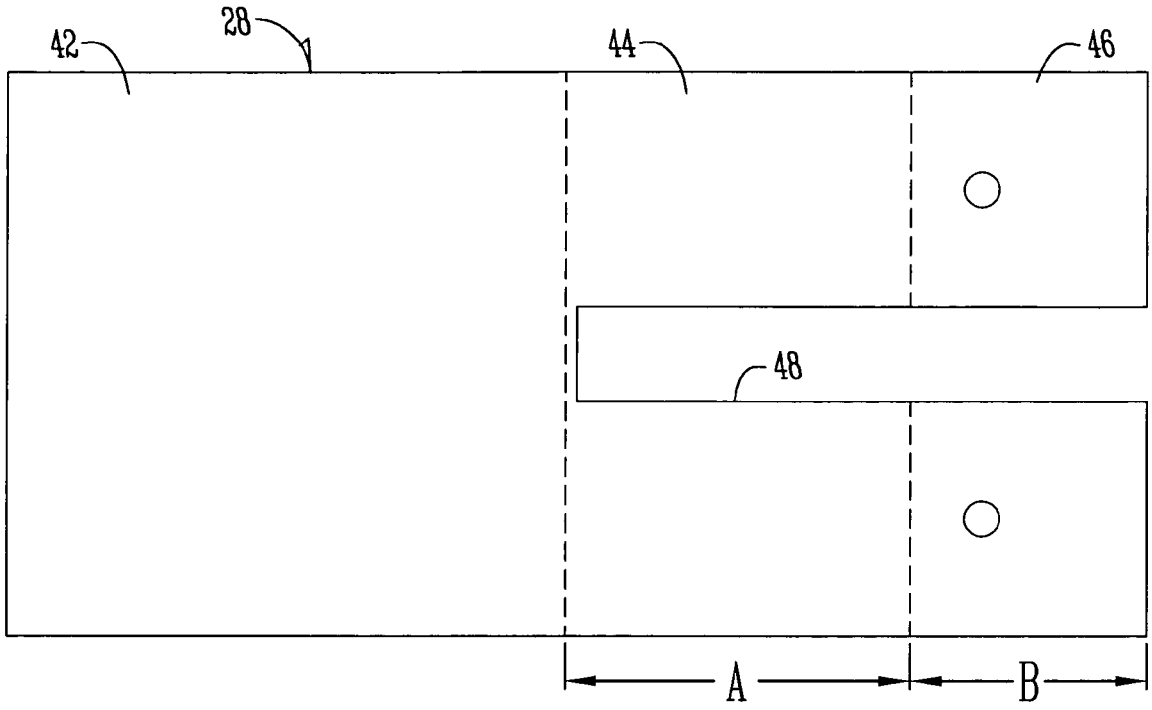
FIG. 4 shows a plan view of a ridge clip in sheet form before metal pressing to make the Z-shape of the clip.
Figure 5:
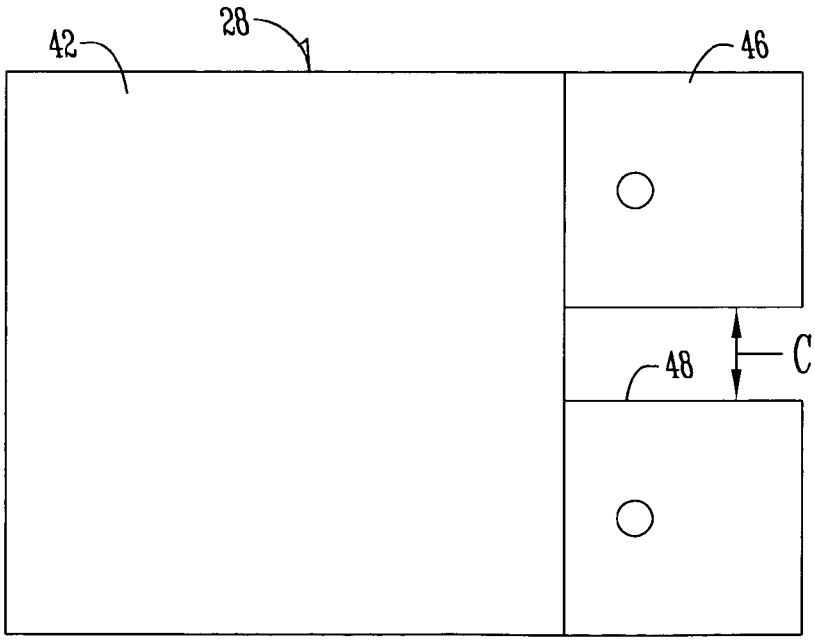
FIG. 5 shows the clip in plan view after press bending and illustrating the width of the notch C.

The main feature of the ridge clip 28 is the attachment area of the ridge clip 28 which supports the ridge cap 26 and provides an area for the screw 34, 36 or a pop rivet to be installed underneath the ridge cap and in an area that is not exposed to weather. A wide variety of notch heights and shapes can be used to match the corrugation patterns commercially available in roofing ribs 50. The dimensions of the notch for its height A and its width C (FIGS. 4 and 5) may vary depending upon precise configuration and dimensions of the notch needed in order to match the corrugation patterns commercially available. Put another way, the clip 28 is notched specifically for the cross-sectional shape and height of the major ribs of the roof panel.

It therefore can be seen that the invention accomplishes at least all of its stated objectives.

What is claimed is:

1. A universal roof ridge clip, comprising:

a Z-shaped clip, having a top fastening area and a bottom anchoring area, joined by a generally upright panel area, having a notch therein to allow roof ribs to pass therethrough, the notch being narrower than the top fastening and bottom anchoring area to thereby assist attachment of the clip; and a universal roof ridge clip in combination with a roof rib passing through said notch, and the universal roof ridge clip and roof rib combination in combination with a ridge cap wherein the top fastening area is a continuous solid panel for supporting the ridge cap.

2. A universal roof ridge clip, comprising:

a Z-shaped clip, having a top fastening area and a bottom anchoring area, joined by a generally upright panel area, having a notch therein to allow roof ribs to pass therethrough, the notch being narrower than the top fastening and bottom anchoring area to thereby assist attachment of the clip; and the bottom anchoring area is secured to any roof panel.

* * * * *